US006673165B2

(12) United States Patent
Koga et al.

(10) Patent No.: US 6,673,165 B2
(45) Date of Patent: Jan. 6, 2004

(54) HIGH-HARDNESS MARTENSITIC STAINLESS STEEL EXCELLENT IN CORROSION RESISTANCE

(75) Inventors: Takeshi Koga, Tokai (JP); Tetsuya Shimizu, Nagoya (JP); Toshiharu Noda, Tajimi (JP)

(73) Assignee: Daido Tokushuko Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/083,120

(22) Filed: Feb. 27, 2002

(65) Prior Publication Data

US 2002/0164260 A1 Nov. 7, 2002

(30) Foreign Application Priority Data

Feb. 27, 2001 (JP) ..... P. 2001-052463

(51) Int. Cl.[7] ..... C22C 38/18; C22C 38/40; C22C 38/42; C22C 38/26; C22C 38/28

(52) U.S. Cl. ..... 148/325; 148/326; 420/34; 420/41; 420/65

(58) Field of Search ..... 148/325, 326; 420/41, 65, 34

(56) References Cited

U.S. PATENT DOCUMENTS 5,411,701 A * 5/1995 Holmberg ..... 420/48

FOREIGN PATENT DOCUMENTS

JP 408134602 A * 5/1996 ..... C22C/38/00
JP 2000-239805 9/2000
JP 2001107195 A * 4/2001 ..... C22C/38/00

OTHER PUBLICATIONS

Key To Steel , 10$^{th}$ Edition 1974, Germany.*

* cited by examiner

*Primary Examiner*—Deborah Yee
(74) *Attorney, Agent, or Firm*—Bacon & Thomas

(57) ABSTRACT

A high-hardness martensitic stainless steel excellent in corrosion resistance, comprising less than 0.15% by weight of C, from 0.10 to 1.0% by weight of Si, from 0.10 to 2.0% by weight of Mn, 0.010% or less of S, from 12.0 to 18.5% by weight of Cr, from 0.40 to 0.80% by weight of N, less than 0.030% by weight of Al, less than 0.020% by weight of O, and substantially the balance of Fe. The martensitic stainless steel of the present invention has cold-workability and hardness after tempering higher than that of SUS420J2 and corrosion resistance equivalent to or higher than that of an austenitic stainless steel SUS316.

7 Claims, 2 Drawing Sheets

HIGH-HARDNESS MARTENSITIC STAINLESS STEEL EXCELLENT IN CORROSION RESISTANCE

FIELD OF THE INVENTION

The present invention relates to a high-hardness martensitic stainless steel excellent in corrosion resistance.

BACKGROUND OF THE INVENTION

As a high-hardness stainless steel having some corrosion resistance, there has heretofore been used a martensitic stainless steel such as SUS420J2 (C: 0.26 to 0.40% by weight; Si: 1.00% by weight or less; Mn: 1.00% by weight or less; P: 0.040% by weight or less; S: 0.030% by weight or less; Cr: 12.00 to 14.00% by weight; the balance being substantially formed by Fe) and SUS440C (C: 0.95 to 1.20% by weight; Si: 1.00% by weight or less; Mn: 1.00% by weight or less; P: 0.040% by weight or less; S: 0.030% by weight or less; Cr: 16.00 to 18.00% by weight; the balance being substantially formed by Fe).

The foregoing martensitic stainless steel is worked into wire, rod, strip, profiled bar, forging, etc. which find wide application such as blade, shaft, bearing, nozzle, valve seat, valve, spring, screw, roll, turbine blade and die.

However, a stainless steel having a high-hardness such as the foregoing martensitic stainless steel comprises C incorporated therein to have desired hardness and thus is disadvantageous in that it is inferior to austenitic stainless steel such as SUS304 and SUS316 in corrosion resistance and thus cannot be used in an atmosphere where it is exposed to water droplets or aqueous solution such as outdoor.

Therefore, parts adapted for use in the foregoing atmosphere are subjected to surface treatment such as plating before use. However, these plated parts are disadvantageous in that some external factors cause damage or exfoliation of metal deposit, resulting in the corrosion of the substrate.

Further, SUS440C, which is said to have highest hardness in stainless steels, has a macrostructural carbide produced therein and thus is disadvantageous in that it exhibits an extremely deteriorated cold-workability.

Moreover, an austenitic stainless steel such as SUS304 and SUS316, which is often used in a corrosive atmosphere, is excellent in corrosion resistance but is normally inferior to martensitic stainless steel in cold-workability and thus can have a hardness of about 40 HRC at maximum. Thus, an austenitic stainless steel cannot have a hardness equivalent to that of hardened martensitic stainless steel.

Then, the inventors developed a high-hardness martensitic stainless steel excellent in corrosion resistance and cold-workability, comprising C in an amount of from 0.10 to 0.40% by weight, Si in an amount of less than 2.0% by weight, Mn in an amount of less than 2.0% by weight, S in an amount of less than 0.010% by weight, Cu in an amount of from 0.01 to 3.0% by weight, Ni in an amount of more than 1.0 to 3.0% by weight, Cr in an amount of from 11.0 to 15.0% by weight, one or more of Mo and W in an amount of from 0.01 to 1.0% in terms of (Mo+½W), N in an amount of from 0.13 to 0.18%, Al in an amount of less than 0.02%, O in an amount of less than 0.010%, optionally, singly or in combination, either or both of Nb and Ta in an amount of from 0.03 to 0.5%, Ti in an amount of from 0.03 to 0.5%, V in an amount of from 0.03 to 0.5%, B in an amount of from 0.001 to 0.01%, Ca in an amount of from 0.001 to 0.01% and Mg in an amount of from 0.001 to 0.01%, and substantially the balance of Fe and applied this martensitic stainless steel for a patent (JP-A-11-41946).

SUMMARY OF THE INVENTION

The martensitic stainless steel disclosed in the above cited application has a reduced content of C to exhibit an enhanced corrosion resistance and cold-workability and has a raised content of N to compensate for the reduction of hardness caused by the reduction of the content of C. However, the proposed martensitic stainless steel has an insufficient content of N and thus is disadvantageous in that it exhibits an insufficient corrosion resistance and hardness.

An object of the invention is to provide a martensitic stainless steel having a better corrosion resistance than that of the foregoing proposed martensitic stainless steel and cold-workability and hardness after annealing higher than that of SUS420J2 and corrosion resistance equivalent to or higher than that of SUS316, which is an austenitic stainless steel, while maintaining cold-workability and hardness after annealing equivalent to or higher than that of SUS420J2.

In order to solve these problems, the inventors made extensive studies of high-hardness martensitic stainless steel excellent in corrosion resistance. As a result, it was found that further reduction of the content of C and further increase of the content of N by pressurized melting make it possible to obtain a high-hardness martensitic stainless steel having a better corrosion resistance.

An ordinary martensitic stainless steel having much carbon content exhibits highest hardness when quenched. When subsequently subjected to heat treatment for tempering, the martensitic stainless steel undergoes some secondary hardening at around 500° C. but shows a hardness drop with the rise of annealing temperature. However, it was found that a martensitic stainless steel having much nitrogen content has a finely divided chromium nitride having a size of 2 $\mu$m or less precipitated intergranularly as shown in the photograph of FIG. 2 when subjected to heat treatment for annealing. As shown in FIG. 1, the martensitic stainless steel exhibits a hardness equivalent to or higher than the hardness obtained when it has been quenched up to around 550° C. Since the chromium nitride precipitated intergranularly is very minute, the corrosion resistance of the martensitic stainless steel shows little or no deterioration.

The invention was accomplished on the basis of the above findings.

The high-hardness martensitic stainless steel excellent in corrosion resistance of the invention comprises less than 0.15% by weight of C, from 0.10 to 1.0% by weight of Si, from 0.10 to 2.0% by weight of Mn, from 12.0 to 18.5% by weight of Cr, from 0.40 to 0.80% by weight of N, less than 0.030% by weight of Al, less than 0.020% by weight of O, and substantially the balance of Fe.

Further, the high-hardness martensitic stainless steel excellent in corrosion resistance of the invention comprises less than 0.15% by weight of C, from 0.10 to 1.0% by weight of Si, from 0.10 to 2.0% by weight of Mn, from 12.0 to 18.5% by weight of Cr, from 0.40 to 0.80% by weight of N, less than 0.030% by weight of Al, less than 0.020% by weight of O, one or more of from 0.20 to 3.0% by weight of Ni, from 0.20 to 3.0% by weight of Cu, from 0.20 to 4.0% by weight of Mo, from 0.50 to 4.0% by weight of Co, from 0.020 to 0.20% by weight of Nb, from 0.020 to 0.20% by weight of V, from 0.020 to 0.20% by weight of W, from 0.020 to 0.20% by weight of Ti, from 0.020 to 0.20% by weight of Ta, from 0.020 to 0.20% by weight of Zr, from 0.0002 to 0.02% by weight of Ca, from 0.001 to 0.01% by weight of Mg, from 0.001 to 0.01% by weight of B, from 0.03 to 0.4% by weight of S, from 0.005 to 0.05% by weight of Te and from 0.02 to 0.20% by weight of Se, and substantially the balance of Fe.

The high-hardness martensitic stainless steel excellent in corrosion resistance of the invention has a finely divided chromium nitride having a size of 2 $\mu$m or less precipitated intergranularly.

DETAILED DESCRIPTION OF THE INVENTION

Figure 1:
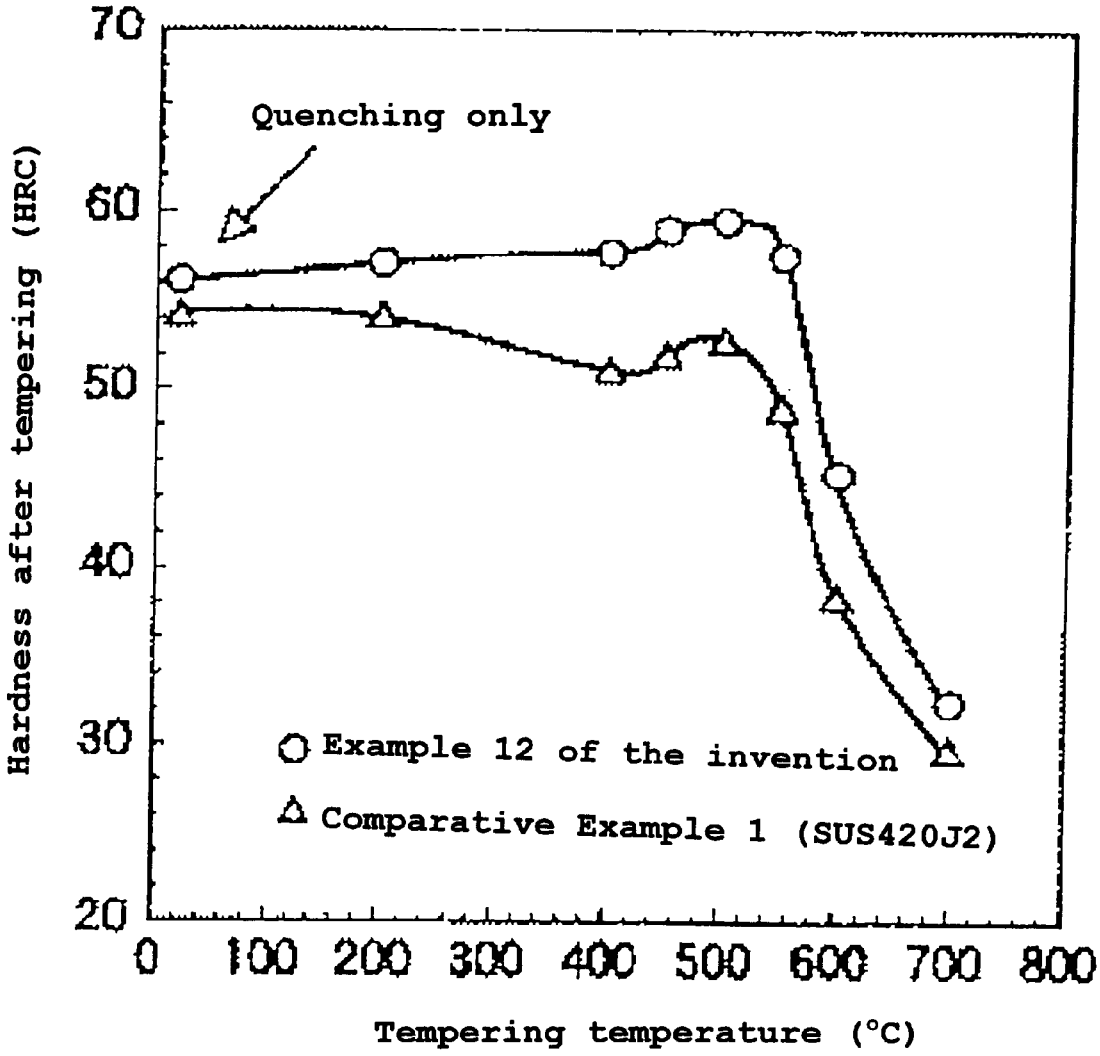
FIG. 1 is a graph illustrating the relationship between the tempering temperature and the hardness after tempering of Example 12 of the invention and Comparative Example 1.

The term "substantially the balance of Fe" as used in this specification means the remainder of Fe and inevitable impurities.

The reason for the determination of the components to be incorporated in the high-hardness martensitic stainless steel excellent in corrosion resistance of the invention and their contents will be described hereinafter.

Unless otherwise indicated, all % in this specification is % by weight based on the total weight of the stainless steel.

C: less than 0.15% by weight

C contributes to the inhibition of nitrogen blow. However, when the content of C increases, the resulting martensitic stainless steel exhibits deteriorated corrosion resistance; thus the upper limit of the content of C is less than 0.15% by weight, preferably 0.10% by weight or less. C is an essential element for enhancing the quenched hardness of ordinary hardened martensitic stainless steel. However, since the quenched hardness of the steel of the invention can be raised by the use of N, the content of C is as small as possible from the standpoint of hardness.

Si: 0.10 to 1.0% by weight

As a deoxidizer, Si lessens oxygen, which deteriorates the cold-workability of the steel, and improves the corrosion resistance of the steel and thus is an element to be incorporated for these purposes. In order to obtain these effects, it is necessary that Si be incorporated in an amount of 0.10% by weight or more, preferably 0.14% by weight or more. However, when the content of Si exceeds 1.0% by weight (in some cases, 0.75% by weight), it may deteriorate the hot-workability of the steel. Further, since Si is a ferrite-forming element, it causes nitrogen blow holes when incorporated in a large amount. Accordingly, the content of Si is from 0.10 to 1.0% by weight, preferably from 0.14 to 0.75% by weight.

Mn: 0.10 to 2.0% by weight

Mn is an austenite-forming element that remarkably increases the dissolution of nitrogen and thus is an element to be incorporated for this purpose. In order to obtain this effect, it is necessary that Mn be incorporated in an amount of 0.10% by weight or more, preferably 0.20% by weight or more. However, when the content of Mn is 2.0% by weight or more (in some cases, 1.55% by weight or more), it may deteriorate the corrosion resistance of the steel. Accordingly, the content of Mn is from 0.10 to 2.0% by weight, preferably from 0.20 to 1.55% by weight.

S: 0.03 to 0.40% by weight

S forms MnS, which deteriorates the corrosion resistance of the steel. Therefore, the content of S is preferably small when the steel is not required to have a good machinability. However, when the steel is required to have a good machinability, the content of S needs to be 0.03% by weight or more. When the content of S is too great, it deteriorates the hot-workability, toughness, hardness and corrosion resistance of the steel. Accordingly, the content of S is 0.40% by weight or less.

Cr: 12.0 to 18.5% by weight

Cr increases the dissolution of nitrogen as well as improves the corrosion resistance of the steel and thus is an element to be incorporated for these purposes. When the content of Cr is less than 12.0% by weight (in some cases, less than 13.5% by weight), it may make it difficult to incorporate N in the steel in an amount of 0.4% by weight or more, which value is high enough to obtain corrosion resistance equivalent to or greater than that of SUS304 or SUS316. Further, when the content of Cr is greater than 18.5% by weight, the amount of retained austenite increases even if the steel is subjected to subzero treatment, lowering the hardness and adding to the cost. Accordingly, the content of Cr is from 12.0 to 18.5% by weight.

N: 0.40 to 0.80% by weight

N is an interstitial element that enhances the hardness and corrosion resistance of martensitic stainless steel and thus is an element to be incorporated for these purposes. When the content of N is less than 0.40% by weight (in some cases, less than 0.43% by weight), the resulting steel may not be provided with a hardness of 56HRC or higher. When the content of N is greater than 0.80% by weight (in some cases, greater than 0.70% by weight), it may cause nitrogen blow holes, making it impossible to obtain a good ingot. Accordingly, the content of N is from 0.40 to 0.80% by weight, preferably from 0.43 to 0.70% by weight.

Al: less than 0.030% by weight

Al is an element to be added as a deoxidizer. When the content of Al is 0.030% by weight or more, the amount of oxides and nitrides thus formed increases to deteriorate the cold-workability of the steel. Accordingly, the content of Al is less than 0.030% by weight.

O: less than 0.020% by weight

O forms an oxide with other metallic elements to deteriorate the cold-workability of the steel. Accordingly, the content of O is less than 0.020% by weight.

Cu: 0.50 to 3.0% by weight

Cu is an austenite-forming element that can form a solidification structure containing much austenite phase. Cu also increases the solid solution of nitrogen as well as improves the corrosion resistance of the steel in a severe atmosphere containing sulfuric acid or the like. Thus, Cu is an element to be incorporated for these purposes. In order to obtain these effects, it is necessary that Cu be incorporated in an amount of 0.50% by weight or more, preferably 0.71% by weight or more. However, when the content of Cu is greater than 3.0% by weight (in some cases, greater than 2.1% by weight), it may deteriorate the hot-workability of the steel as well as increases the content of retained austenite to lower the hardness of hardened steel and raise the solid dissolving temperature of nitride. Accordingly, the content of Cu is from 0.50 to 3.0%, preferably from 0.71 to 2.1% by weight.

Ni: 0.50 to 3.0% by weight

Like Cu, Ni is an austenite-forming element that can form a solidification structure containing much austenite phase. Ni also increases the solid solution of nitrogen as well as improves the corrosion resistance of the steel. Thus, Ni is an element to be incorporated for these purposes. In order to obtain these effects, it is necessary that Ni be incorporated in an amount of 0.50% by weight or more, preferably 1.0% by weight or more. However, when the content of Ni is greater than 3.0% by weight (in some cases, greater than 1.95% by weight), it may be made impossible to lower the hardness of annealed steel, deteriorating the cold-workability of the steel. This also increases the content of retained austenite, lowering the hardness of hardened steel and raising the solid dissolving temperature of nitride. Accordingly, the content of Ni is from 0.50 to 3.0% by weight, preferably from 1.0 to 1.95% by weight.

Mo: 0.50 to 4.0% by weight

Mo increases the dissolution of nitrogen as well as improves the corrosion resistance of the steel and thus is an element to be incorporated for these purposes. In order to obtain these effects, it is necessary that Mo be incorporated in an amount of 0.50% by weight or more, preferably 1.0% by weight or more. However, when the content of Mo is greater than 4.0% by weight (in some cases, greater than 3.0% by weight), it may be made difficult to secure austenite phase effective for the inhibition of nitrogen blow holes which occurs during solidification. Accordingly, the content of Mo is from 0.50 to 4.0% by weight, preferably from 1.0 to 3.0% by weight.

Co: 0.50 to 4.0% by weight

Co is an austenite-forming element that can form a solidification structure containing much austenite phase. Co also increases the solid solution of nitrogen as well as raises Ms point and hence decreases the content of retained austenite. Thus, Co can be used to provide the hardened steel with desired hardness and is an element to be incorporated for these purposes. In order to obtain these effects, it is necessary that Co be incorporated in an amount of 0.50% by weight or more, preferably 1.0% by weight or more. However, when the content of Co is greater than 4.0% by weight (in some cases, greater than 3.0% by weight), it may deteriorate the hot-workability of the steel as well as raise the solid dissolving temperature of nitride and adds to the cost. Accordingly, the content of Co is from 0.50 to 4.0% by weight, preferably from 1.0 to 3.0% by weight.

Nb, V, W, Ti, Ta and Zr: 0.010 to 0.2% by weight

Nb, V, W, Ti, Ta and Zr each form a carbonitride that exerts a pinning effect to finely divide the grains and hence enhance the strength of the steel and thus each are an element to be incorporated for these purposes. In order to obtain these effects, it is necessary that Nb, V, W, Ti, Ta and Zr each be incorporated in an amount of 0.010% by weight or more, preferably 0.030% by weight or more. However, when the content of Nb, V, W, Ti, Ta and Zr each is 0.2% by weight or more (in some cases, 0.15% by weight or more), coarse nitrides could be formed, deteriorating the corrosion resistance and fatigue strength of the steel. Accordingly, the content of Nb, V, W, Ti, Ta and Zr each are from 0.010 to 0.2% by weight, preferably from 0.030 to 0.15% by weight.

Ca, Mg and B: 0.001 to 0.01% by weight

Ca, Mg and B each improve the hot-workability of the steel and thus each are an element to be incorporated for this purpose. In order to obtain this effect, it is necessary that Ca, Mg and B each be incorporated in an amount of 0.001% by weight or more. When the content of Ca, Mg and B each are greater than 0.01% by weight, it deteriorates the hot-workability of the steel. Accordingly, the content of Ca, Mg and B each are from 0.001 to 0.01% by weight. Further, Ca improves the machinability of the steel and thus can be incorporated in an amount of from 0.0002 to 0.02% by weight.

Te: 0.005 to 0.05% by weight

Te improves the machinability of the steel and thus is an element to be incorporated for this purpose. In order to obtain this effect, it is necessary that Te be incorporated in an amount of 0.005% by weight or more. However, when the content of Te is greater than 0.05% by weight, it deteriorates the toughness and hot-workability of the steel. Accordingly, the content of Te is from 0.005 to 0.05% by weight.

Se: 0.02 to 0.20% by weight

Se improves the machinability of the steel and thus is an element to be incorporated for this purpose. In order to obtain this effect, it is necessary that Se be incorporated in an amount of 0.02% by weight or more. However, when the content of Se is greater than 0.20% by weight, it deteriorates the toughness of the steel. Accordingly, the content of se is from 0.02 to 0.20% by weight.

An example of the process for the production of the high-hardness martensitic stainless steel excellent in corrosion resistance of the invention comprises melting a steel having the alloy formulation in a melting furnace such as pressurized induction furnace, casting into an ingot, billet or slab, and then hot-forging or hot-rolling the ingot or the like into a steel material having a required size.

An example of the heat treatment of the high-hardness martensitic stainless steel excellent in corrosion resistance of the invention will be described hereinafter.

For annealing, the steel can be heated to a temperature of $A_{c3}$ transformation +30° C. to 70° C. for 3 to 5 hours, furnace-cooled close to 650° C. at a rate of from 10 to 20° C./hr, and then air-cooled.

For quenching-tempering, the steel can be heated to a temperature of from 1,000° C. to 1,200° C. for 0.5 to 1.5 hours, and then oil-cooled so that it is quenched, heated to a temperature of from 200° C. to 700° C. for 0.5 to 1.5 hours, and then air-cooled so that it is tempered.

The high-hardness martensitic stainless steel excellent in corrosion resistance of the invention can be used for purposes requiring excellent corrosion resistance and high-hardness, e.g., uses for which SUS420J2 has been used (such as blade, shaft, bearing, nozzle, valve seat, valve, spring, screw, roll, turbine blade and die) and some uses for which SUS440C has been used.

The high-hardness martensitic stainless steel excellent in corrosion resistance of the invention has the foregoing formulation, particularly much N content. In this arrangement, the high-hardness martensitic stainless steel of the invention is slightly inferior to martensitic stainless steel SUS420J2 (Comparative Example 1) but is much superior to SUS440C (Comparative Example 2) in cold-workability after annealing and is superior to the austenitic stainless steel SUS304 (Comparative Example 3) in the corrosion resistance after quenching-tempering.

Figure 2:
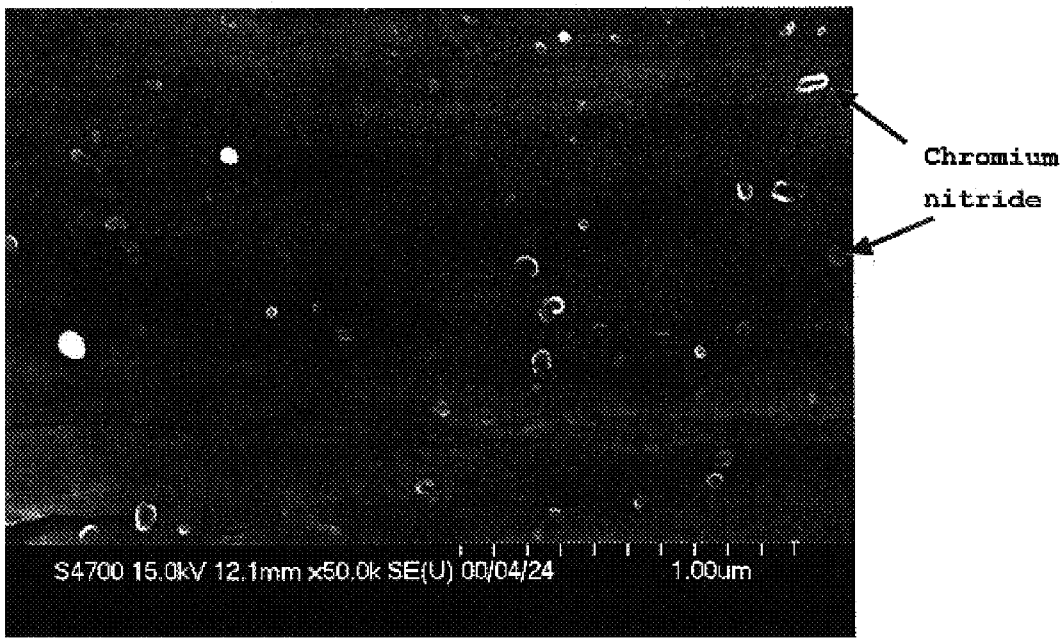
FIG. 2 is a scanning electron microphotograph of the steel of Example 12 of the invention which has been tempered at a temperature of 500° C.

When subjected to quenching and tempering, the high-hardness martensitic stainless steel of the invention exhibits hardness of not lower than that obtained by quenching up to around 550° C. as shown in FIG. 1. This is because a finely divided chromium nitride (white portion) having a size of 2 μm or less is precipitated in the crystal particles as shown in the photograph of FIG. 2 (scanning electron microphotograph of the steel of Example 12 of the invention which has been tempered at a temperature of 500° C.). Further, since the chromium nitride precipitated intergranularly is very minute, the steel shows little deterioration of corrosion resistance as shown in FIG. 2.

Moreover, the hardness of the steel which has been quenched and tempered is higher than the hardness of SUS440C which has been quenched and tempered, which is said to be hardest in stainless steels.

EXAMPLES 1 TO 39, COMPARATIVE EXAMPLES 1 TO 5, AND TEST EXAMPLE 1

Steels of the examples of the present invention and the steels of the comparative examples set forth in Table 1 below in an amount of 50 kg were each melted in a pressurized induction furnace, and then casted into an ingot in an amount of 50 kg. A test specimen having a size of 6 mmϕ×110 mm long was then collected from the ingot of Example 2 of the invention and those comprising hot-workability improving ingredients incorporated therein among these ingots. These test specimens were each subjected to gleeble test for evaluation of hot-workability. The results are set forth in Table 2 below. Subsequently, these ingots were each forged to a bar having a diameter of 20 mm. A material was then collected from the sound part of the bar. The material was heated to a temperature of $A_{c3}$ formation +50° C. for 4 hours, furnace-cooled to a temperature of 650° C. at a rate of 15° C./hr, and then air-cooled. An end face constraint compression test specimen having a size of 15 mmϕ×22.5 mm high was then collected from each of these bars to evaluate the cold-workability thereof. These test specimens were each then subjected to constrained upset test in the following method. The results are set forth in Table 2 below.

Subsequently, a hardness test specimen, a salt spray test specimen and a pitting corrosion potential measuring test specimen were collected from each of the foregoing bars. Thereafter, those of the examples of the invention were each subjected to quenching involving heat treatment to 1,150° C. for 1 hour followed by oil cooling. Those having much retained austenite and an insufficient hardness after quenching were each subjected to subzero treatment (−80° C.). Referring to those of comparative examples, Comparative Examples 1 and 2 were each subjected to heat treatment in the same manner as in the examples of the invention and Comparative Examples 3 to 5 were each subjected to heat treatment involving heating to a temperature of 1,050° C. for 1 hour followed by water cooling.

The test specimens which had thus been subjected to heat treatment were each then subjected to hardness test, salt spray test and pitting corrosion potential measurement test in the following manner. The results are set forth in Table 2 below.

A hardness test specimen, a salt spray test specimen and a machinability test specimen were collected from each of the foregoing rods (machinability test specimen was collected from the rods of Example 2 and those comprising machinability-improving ingredients incorporated therein). These specimens were each subjected to quenching involving heating to a temperature of 1,150° C. for 1 hour followed by oil cooling, and then annealing involving heating to a temperature of 500° C. for 1 hr followed by air cooling. These test specimens were each then subjected to hardness test, salt spray test and machinability test in the following manner. The results are set forth in Table 2 below.

All the kinds of steels had a P content of 0.03% by mass or less.

The gleeble test was conducted every 50° C. in the range of from 900° C. to 1,300° C. Those showing an increase of temperature range within which the reduction of area is 40% or more per base steel were judged G (good). Those showing no change of temperature range within the reduction of area is 40% or more per base steel were judged F (fair). Those showing a decrease of temperature range within the reduction of area is 40% or more per base steel were judged P (poor).

For constrained upset test, a test specimen having a size of 15 mmϕ and 22.5 mm high was subjected to constrained upset to determine the reduction of area. For each face, 10 specimens were tested. The reduction of area at which cracking occurs at a probability of 50% was defined to be critical crack.

For the hardness test, HRC was employed.

The salt spray test was conducted according to JIS Z 2371. Those showing no corrosion were judged A. Those showing some corrosion were judged B. Those showing corrosion were judged C. Those showing corrosion on the entire surface thereof were judged D.

The pitting corrosion potential measurement was conducted according to JIS G 0577. For the evaluation of pitting corrosion potential, V'c10 was employed.

For the tool life test in drilling for the evaluation of machinability, a straight shank drill was used as a tool. No lubricant was used. The tool life test in drilling conducted at a feed rate of 0.07 mm until the test specimen became uncuttable. For the evaluation of machinability, the cutting speed at which the test specimen becomes uncuttable over a cutting length of 1,000 mm was determined relative to that of Example 2 as 1.0.

TABLE 1

| Example | Na | C | Sl | Mn | S | Cr | N | Al | O | Nl | Cu | Mo | Co | Nb | V | W | Tl | Ta | Zr | B,Ca,Mg | (% by weight) S,Te,Se |
|---|---|---|---|---|---|---|---|---|---|---|---|---|---|---|---|---|---|---|---|---|---|
| 1 | | 0.01 | 0.15 | 0.61 | 0.001 | 13.5 | 0.43 | 0.012 | 0.005 | | | | | | | | | | | | |
| 2 | | 0.01 | 0.14 | 0.52 | 0.002 | 15.3 | 0.51 | 0.006 | 0.004 | | | | | | | | | | | | |
| 3 | | 0.02 | 0.19 | 1.53 | 0.002 | 17.5 | 0.71 | 0.002 | 0.006 | | | | | | | | | | | | |
| 4 | | 0.11 | 0.20 | 0.45 | 0.002 | 15.0 | 0.50 | 0.003 | 0.005 | | | | | | | | | | | | |
| 5 | | 0.05 | 0.71 | 1.20 | 0.002 | 15.3 | 0.48 | 0.006 | 0.003 | | | | | | | | | | | | |
| 6 | | 0.03 | 0.30 | 0.50 | 0.002 | 15.1 | 0.51 | 0.008 | 0.002 | 2.02 | | | | | | | | | | | |
| 7 | | 0.02 | 0.20 | 0.43 | 0.001 | 14.9 | 0.49 | 0.010 | 0.004 | 1.10 | 1.48 | | | | | | | | | | |
| 8 | | 0.12 | 0.23 | 0.61 | 0.001 | 15.3 | 0.43 | 0.008 | 0.008 | 0.53 | 0.48 | | | | | | | | | | |
| 9 | | 0.05 | 0.15 | 0.51 | 0.004 | 15.9 | 0.44 | 0.010 | 0.007 | | 2.10 | | | | | | | | | | |
| 10 | | 0.05 | 0.35 | 0.24 | 0.001 | 15.3 | 0.52 | 0.011 | 0.006 | 1.10 | 1.01 | 1.50 | | | | | | | | | |
| 11 | | 0.02 | 0.38 | 1.50 | 0.003 | 15.1 | 0.53 | 0.006 | 0.008 | 1.20 | 0.80 | | 2.10 | | | | | | | | |
| 12 | | 0.02 | 0.25 | 0.64 | 0.001 | 15.6 | 0.56 | 0.007 | 0.005 | 1.21 | 1.53 | | | 0.05 | | | | | | | |
| 13 | | 0.02 | 0.15 | 0.80 | 0.008 | 16.1 | 0.58 | 0.006 | 0.005 | 0.58 | 1.81 | | | 0.12 | 0.08 | | | | | | |
| 14 | | 0.03 | 0.23 | 0.65 | 0.001 | 15.5 | 0.55 | 0.007 | 0.006 | 1.01 | 1.60 | | | 0.15 | 0.12 | 0.05 | | | | | |
| 15 | | 0.02 | 0.19 | 0.80 | 0.004 | 15.1 | 0.57 | 0.003 | 0.006 | 1.50 | 1.60 | | | | 0.05 | 0.05 | 0.05 | | | | |
| 16 | | 0.12 | 0.25 | 0.40 | 0.003 | 15.1 | 0.51 | 0.001 | 0.003 | 0.81 | 1.45 | | | | | 0.05 | | 0.05 | | | |
| 17 | | 0.06 | 0.31 | 0.65 | 0.002 | 14.1 | 0.45 | 0.002 | 0.005 | 0.60 | 0.71 | | | | | | | 0.08 | 0.05 | | |
| 18 | | 0.01 | 0.20 | 0.80 | 0.002 | 15.3 | 0.52 | 0.001 | 0.006 | 1.30 | 0.81 | | | | | 0.12 | | 0.03 | | | |
| 19 | | 0.01 | 0.16 | 0.51 | 0.005 | 18.2 | 0.48 | 0.001 | 0.004 | | | | | 0.08 | | | | | | | |
| 20 | | 0.02 | 0.21 | 0.53 | 0.008 | 15.3 | 0.52 | 0.003 | 0.006 | | | | | | 0.13 | | | | | | |
| 21 | | 0.01 | 0.31 | 0.64 | 0.004 | 15.7 | 0.55 | 0.002 | 0.003 | | | | | | | 0.11 | | | | | |
| 22 | | 0.03 | 0.15 | 0.52 | 0.005 | 15.1 | 0.51 | 0.003 | 0.006 | | | | | | | | 0.09 | | | | |
| 23 | | 0.01 | 0.21 | 0.61 | 0.006 | 14.8 | 0.48 | 0.004 | 0.002 | | | | | | | | | 0.05 | | | |
| 24 | | 0.02 | 0.23 | 0.41 | 0.002 | 15.6 | 0.56 | 0.001 | 0.001 | | | | | | | | | | 0.04 | | |
| 25 | | 0.01 | 0.21 | 0.51 | 0.001 | 14.8 | 0.51 | 0.001 | 0.002 | | | | | | | | | | | Ca:0.0031 | |
| 26 | | 0.01 | 0.15 | 0.68 | 0.002 | 15.3 | 0.58 | 0.002 | 0.003 | | | | | | | | | | | Ba:0.0016 | |
| 27 | | 0.01 | 0.14 | 0.51 | 0.001 | 15.8 | 0.54 | 0.001 | 0.003 | | | | | | | | | | | Mg:0.0014 | |
| 28 | | 0.01 | 0.21 | 0.54 | | 15.2 | 0.48 | 0.002 | 0.001 | | | | | | | | | | | | S:0.21 |
| 29 | | 0.02 | 0.24 | 0.50 | | 15.6 | 0.51 | 0.001 | 0.003 | | | | | | | | | | | | S:0.15 Te:0.03 |
| 30 | | 0.01 | 0.23 | 0.48 | 0.001 | 15.1 | 0.47 | 0.002 | 0.004 | | | | | | | | | | | | Se:0.18 |
| 31 | | 0.02 | 0.31 | 0.64 | 0.002 | 17.7 | 0.61 | 0.003 | 0.004 | 0.81 | | | | | | | | | | Ca:0.0028 | S:0.14 |
| 32 | | 0.03 | 0.21 | 0.49 | | 18.1 | 0.60 | 0.001 | 0.002 | | 0.52 | 1.03 | | | | | | | | | |
| 33 | | 0.01 | 0.25 | 0.51 | 0.003 | 17.3 | 0.57 | 0.002 | 0.004 | 0.53 | | | | | | 0.07 | 0.06 | | | B:0.0019 | |
| 34 | | 0.04 | 0.31 | 0.56 | 0.004 | 15.3 | 0.51 | 0.003 | 0.003 | | | | 2.12 | | | | | | | | Se:0.11 |
| 35 | | 0.02 | 0.24 | 0.48 | 0.004 | 15.3 | 0.52 | 0.001 | 0.002 | | | 1.01 | | | | | 0.05 | | | Ca:0.0016 | Se:0.12Te:0.04 |
| 36 | | 0.01 | 0.41 | 0.47 | | 14.8 | 0.48 | 0.005 | 0.003 | 0.54 | | | | | | | | | | Mg:0.0021 | S:0.13 |
| 37 | | 0.01 | 0.31 | 0.54 | 0.001 | 15.6 | 0.53 | 0.006 | 0.004 | | | | | 0.09 | 0.13 | | | | | Ca:0.0023 | |
| 38 | | 0.01 | 0.25 | 0.53 | 0.003 | 17.2 | 0.51 | 0.004 | 0.002 | | | | | | | | | | | | Se:0.16 |
| 39 | | 0.01 | 0.20 | 0.51 | | 16.1 | 0.57 | 0.005 | 0.003 | | | | | | | | | | | Mg:0.0019 | S:0.25 |
| Comparative Example | | | | | | | | | | | | | | | | | | | | | |
| 1 | | 0.31 | 0.21 | 0.45 | 0.030 | 13.2 | 0.01 | | | 0.08 | 0.08 | 0.01 | | | | | | | | | |
| 2 | | 1.01 | 0.20 | 0.40 | 0.040 | 16.5 | 0.02 | | | 0.02 | 0.10 | 0.02 | | | | | | | | | |
| 3 | | 0.06 | 0.51 | 1.21 | 0.010 | 18.1 | 0.03 | | | 7.70 | 0.12 | 0.03 | | | | | | | | | |

TABLE 1-continued

| Example Na | C | Sl | Mn | S | Cr | N | Al | O | Nl | Cu | Mo | Co | Nb | V | W | Tl | Ta | Zr | B,Ca,Mg | (% by weight) S,Te,Se |
|---|---|---|---|---|---|---|---|---|---|---|---|---|---|---|---|---|---|---|---|---|
| 4 | 0.04 | 0.34 | 1.12 | 0.010 | 18.3 | 0.02 | | | 11.60 | 0.21 | 2.31 | | | | | | | | | |
| 5 | 0.20 | 0.18 | 0.18 | 0.003 | 14.1 | 0.14 | | | 1.10 | 1.02 | 0.89 | | | | | | | | | |

Comparative Example 1: SUS420J2
Comparative Example 2: SUS440C
Comparative Example 3: SUS304
Comparative Example 4: SUS316
Comparative Example 5: Example 2 of JP-A-11-41948

TABLE 2

| | No. | Cold-work-ability (% critical compression) | Quenching (subzero) Hardness (HRC) | Corrosion resistance Salt spray test | Corrosion resistance Pitting corrosion potential (VvsS.C.E.) | Quenching-annealing (500° C.) Hardness (HRC) | Corrosion resistance Salt spray test | Machin-ability | Hot-work-ability |
|---|---|---|---|---|---|---|---|---|---|
| Example of the Invention | 1 | 80.0 | 55.1 | A | 0.38 | 58.3 | A | | |
| | 2 | 75.0 | 56.2 | A | 0.45 | 59.5 | A | 1.0 | F |
| | 3 | 70.0 | 58.1 | A | 0.68 | 62.1 | A | | |
| | 4 | 72.5 | 57.2 | A | 0.41 | 60.2 | A | | |
| | 5 | 72.5 | 56.3 | A | 0.43 | 58.8 | A | | |
| | 6 | 70.0 | 56.1 | A | 0.45 | 59.3 | A | | |
| | 7 | 70.0 | 55.9 | A | 0.48 | 58.7 | A | | |
| | 8 | 70.0 | 57.1 | A | 0.42 | 60.3 | A | | |
| | 9 | 70.0 | 55.7 | A | 0.41 | 58.1 | A | | |
| | 10 | 70.0 | 56.8 | A | 0.61 | 59.2 | A | | |
| | 11 | 67.5 | 56.9 | A | 0.52 | 58.9 | A | | |
| | 12 | 70.0 | 56.6 | A | 0.46 | 59.5 | A | | |
| | 13 | 70.0 | 56.7 | A | 0.48 | 58.6 | A | | |
| | 14 | 70.0 | 56.6 | A | 0.48 | 58.4 | A | | |
| | 15 | 67.5 | 56.4 | A | 0.46 | 59.1 | A | | |
| | 16 | 70.0 | 55.9 | A | 0.42 | 58.1 | A | | |
| | 17 | 72.5 | 55.5 | A | 0.42 | 57.9 | A | | |
| | 18 | 70.0 | 56.1 | A | 0.43 | 58.1 | A | | |
| | 19 | 70.0 | 55.3 | A | 0.51 | 58.5 | A | | |
| | 20 | 72.5 | 55.4 | A | 0.39 | 58.1 | A | | |
| | 21 | 72.5 | 56.1 | A | 0.42 | 59.1 | A | | |
| | 22 | 70.0 | 55.3 | A | 0.45 | 58.1 | A | | |
| | 23 | 72.5 | 55.6 | A | 0.39 | 58.8 | A | | |
| | 24 | 67.5 | 56.3 | A | 0.46 | 60.1 | A | | |
| | 25 | 75.0 | 56.1 | A | 0.42 | 59.8 | A | | G |
| | 26 | 72.5 | 56.9 | A | 0.56 | 60.8 | A | | G |
| | 27 | 72.5 | 56.1 | A | 0.50 | 58.7 | A | | G |
| | 28 | — | 55.8 | A | 0.27 | 58.8 | A | 1.3 | |
| | 29 | — | 55.3 | A | 0.29 | 58.6 | A | 1.3 | |
| | 30 | — | 55.1 | A | 0.31 | 58.1 | A | 1.2 | |
| | 31 | 70.0 | 57.6 | A | 0.52 | 60.1 | A | | G |
| | 32 | — | 58.2 | A | 0.35 | 61.2 | A | 1.2 | |
| | 33 | 70.0 | 55.9 | A | 0.48 | 58.6 | A | | G |
| | 34 | — | 55.8 | A | 0.31 | 58.2 | A | 1.2 | |
| | 35 | — | 56.3 | A | 0.32 | 59.7 | A | 1.2 | |
| | 36 | — | 55.7 | A | 0.27 | 58.3 | A | 1.2 | |
| | 37 | 70.0 | 56.3 | A | 0.42 | 59.1 | A | 1.1 | |
| | 38 | — | 55.7 | A | 0.29 | 58.1 | A | 1.2 | |
| | 39 | — | 55.8 | A | 0.28 | 58.6 | A | 1.5 | |
| Comparative Example | 1 | 72.5 | 54.5 | C | 0.01 | 52.8 | D | 0.9 | |
| | 2 | 40.0 | 62.3 | D | −0.11 | 54.3 | D | | |
| | 3 | 77.5 | — | A | 0.26 | — | — | | |
| | 4 | 77.5 | — | A | 0.38 | — | — | | |
| | 5 | 77.5 | 54.0 | B | 0.25 | — | — | | |

TEST EXAMPLE 2

A hardness test specimen was collected from each of the bars of Example 12 of the invention and Comparative Example 1 above. These test specimens were each subjected to quenching involving heating to a temperature of 1,150° C. for 1 hour followed by oil cooling and then to annealing involving heating to a temperature of from 100° C. to 700° C. for 1 hour followed by air cooling. These test specimens were each then subjected to hardness test in the following manner. The results are set forth in FIG. 1.

As can be seen in the results set forth in Table 2 above, the cold-workability (critical upset ratio) of the examples of the invention were from 67.5% to 80.0%, which value is somewhat lower than that of Comparative Example 3 (SUS304) and Comparative Example 4 (SUS316) of austenitic stainless steel and Comparative Example 5 of conventional martensitic stainless steel but about the same as that of Comparative Example 1 (SUS420J2) of conventional martensitic stainless steel and far better than that of Comparative Example 2 (SUS440C) of conventional martensitic stainless steel.

The steels of the invention which had been quenched, and then tempered at a temperature of 500° C. exhibited a hardness of from 57.9 to 62.1 HRC, which is about 3 HRC higher than the hardness of the steels of the examples of the invention which have been quenched or quenched and sub-zeroed (55.1 to 58.2 HRC). On the contrary, Comparative Examples 1 and 2 of conventional martensitic stainless steel which had been quenched, and then tempered at a temperature of 500° C. exhibited a hardness of 52.8 HRC and 54.3 HRC, respectively, which are slightly or far lower than that of the same steels which have been quenched (54.5 HRC and 62.3 HRC, respectively). The hardness of the steels of the invention which had been quenched, and then tempered at a temperature of 500° C. each were far higher than that of the steels of Comparative Examples 1 and 2 which had been quenched, and then tempered at a temperature of 500° C. and slightly lower than that of the steel of Comparative Example 2 which had been quenched.

Referring to the results of salt spray test on the examples of the invention, all those which had been quenched or quenched and sub-zeroed and those which had been quenched, and then tempered at a temperature of 500° C. were judged A (showing no corrosion). The results were about the same as that of Comparative Examples 3 and 4 of austenitic stainless steel. However, both Comparative Examples 1 and 2 of conventional martensitic stainless steel were judged C (showing corrosion) or D (showing corrosion on the entire surface).

The results of the pitting corrosion potential measurement of the examples of the invention were from 0.27 to 0.68 V vs S.C.E. Some of these results were almost the same as that of Comparative Examples 3 and 4 of austenitic stainless steel. However, most of these results were higher than that of these comparative examples and far higher than that of Comparative Examples 1 and 2.

Examples 28 to 30, 32, and 34 to 39 of the invention, which comprise machinability-improving ingredients incorporated therein, exhibited machinability of from 1.1 to 1.3 times that of Example 2 of the invention, which is free of machinability-improving ingredients.

Examples 25 to 27, 31 and 33, in which comprise hot-workability improving ingredients incorporated, showed an increase of temperature range within which the reduction of area per Example 2 of the invention having hot-workability improving ingredients is 40% or more, and thus exhibited an excellent hot-workability.

As can be seen in the results shown in FIG. 1, the hardness of Example 12 of the invention shows a gradual increase from the value obtained when the steel has been quenched (56.6 HRC) up to a tempering temperature of about 400° C. and then sudden increase until it reaches maximum of 59.5 HRC at a tempering temperature of 500° C.

On the contrary, the hardness of Comparative Example 1 (SUS420J2) shows a gradual decrease from the value obtained when the steel has been quenched (54.5 HRC) up to a tempering temperature of about 400° C. and then sudden increase until it reaches 52.8 HRC at an annealing temperature of 500° C., which is not higher than the value obtained when the steel has been quenched.

The high-hardness martensitic stainless steel excellent in corrosion resistance of the invention has the following constitution and thus has the following advantages.

(1) The high-hardness martensitic stainless steel of the invention exhibits a hardness far higher than SUS420J2 but is equivalent to SUS420J2 in cold-workability and much better than SUS420J2 in corrosion resistance.

(2) The high-hardness martensitic stainless steel of the invention is slightly inferior to SUS316 in cold-workability but is about the same as SUS316 in corrosion resistance and has a hardness far higher than SUS316.

(3) As compared with SUS440C, which is said to have the highest hardness in stainless steels, the high-hardness martensitic stainless steel of the invention is very excellent in cold-workability and corrosion resistance and exhibits a very high-hardness when tempered.

(4) The high-hardness martensitic stainless steel of the invention has no or little Ni and thus can be produced at a reduced cost.

While the invention has been described in detail and with reference to specific embodiments thereof, it will be apparent to one skilled in the art that various changes and modifications can be made therein without departing from the scope thereof.

This application is based on Japanese patent application No. 2001-052463 filed Feb. 27, 2001, the entire contents thereof being hereby incorporated by reference.

What is claimed is:

1. A high-hardness martensitic stainless steel excellent in corrosion resistance, comprising less than 0.15% by weight of C, from 0.10 to 1.0% by weight of Si, from 0.10 to 2.0% by weight of Mn, from 12.0 to 18.5% by weight of Cr, from 0.40 to 0.80% by weight of N, less than 0.030% by weight of Al, less than 0.020% by weight of O, and substantially the balance of Fe.

2. A high-hardness martensitic stainless steel excellent in corrosion resistance, comprising less than 0.15% by weight of C, from 0.10 to 1.0% by weight of Si, from 0.10 to 2.0% by weight of Mn, from 12.0 to 18.5% by weight of Cr, from 0.40 to 0.80% by weight of N, less than 0.030% by weight of Al, less than 0.020% by weight of O, one or more of from 0.20 to 3.0% by weight of Ni, from 0.20 to 3.0% by weight of Cu, from 0.20 to 4.0% by weight of Mo and from 0.50 to 4.0% by weight of Co, and substantially the balance of Fe.

3. A high-hardness martensitic stainless steel excellent in corrosion resistance comprising less than 0.15% by weight of C, from 0.10 to 1.0% by weight of Si, from 0.10 to 2.0% by weight of Mn, from 12.0 to 18.5% by weight of Cr, from 0.40 to 0.80% by weight of N, less than 0.030% by weight of Al, less than 0.020% by weight of O, one or more of Nb, V, W, Ti, Ta and Zr in a respective amount of from 0.020 to 0.20% by weight, and substantially the balance of Fe.

4. A high-hardness martensitic stainless steel excellent in corrosion resistance, comprising less than 0.15% by weight of C, from 0.10 to 1.0% by weight of Si, from 0.10 to 2.0% by weight of Mn, from 12.0 to 18.5% by weight of Cr, from 0.40 to 0.80% by weight of N, less than 0.030% by weight of Al, less than 0.020% by weight of O, one or more of from 0.20 to 3.0% by weight of Ni, from 0.20 to 3.0% by weight of Cu, from 0.20 to 4.0% by weight of Mo and from 0.50 to 4.0% by weight of Co, one or more of Nb, V, W, Ti, Ta and Zr in a respective amount of from 0.020 to 0.20% by weight and substantially the balance of Fe.

5. The high-hardness martensitic stainless steel excellent in corrosion resistance according to any one of claims 1 to 4, wherein Fe is partly replaced by the totally same mount of one or more of Ca, Mg and B each in a respective amount of from 0.001 to 0.01% by weight.

6. The high-hardness martensitic stainless steel excellent in corrosion resistance according to any one of claims 1 to 4, wherein Fe is partly replaced by the totally same mount of one or more of S, Te, Se and Ca (excluded if Ca is incorporated for the purpose of improving hot-workability) in an amount of from 0.03 to 0.4%, from 0.005 to 0.05%, from 0.02 to 0.20% and from 0.0002 to 0.02%, respectively.

7. The high-hardness martensitic stainless steel excellent in corrosion resistance according to any one of claims 1 to 4, having a finely divided chromium nitride having a size of 2 $\mu$m or less precipitated intergranularly.

* * * * *